US009291425B2

(12) United States Patent
Golob et al.

(10) Patent No.: US 9,291,425 B2
(45) Date of Patent: Mar. 22, 2016

(54) WEAPON SLING

(71) Applicant: Patrol Incident Gear, LLC., Pacific, MO (US)

(72) Inventors: Simon L. Golob, Glasow, MT (US); Julie A. Golob, Glasow, MT (US)

(73) Assignee: Patrol Incident Gear, LLC., Highland Falls, NY (US)

( * ) Notice: Subject to any disclaimer, the term of this patent is extended or adjusted under 35 U.S.C. 154(b) by 0 days.

(21) Appl. No.: 13/902,340

(22) Filed: May 24, 2013

(65) Prior Publication Data

US 2014/0346199 A1 Nov. 27, 2014

(51) Int. Cl.
*F41C 33/00* (2006.01)

(52) U.S. Cl.
CPC ..... *F41C 33/002* (2013.01); *F41C 33/001* (2013.01)

(58) Field of Classification Search
CPC ..... F41C 33/001; F41C 33/002
USPC ..... 224/150, 149, 916
See application file for complete search history.

(56) References Cited

U.S. PATENT DOCUMENTS 1,383,125 A * 6/1921 Kennedy, Jr. ..... F41C 33/00 224/150
1,396,270 A * 11/1921 Grierson ..... F41C 33/001 224/150
1,519,123 A * 12/1924 Edwards ..... 2/94
2,357,363 A * 9/1944 Smith et al. ..... 224/150
2,446,197 A * 8/1948 Sloan ..... F41C 33/001 224/150
2,550,433 A * 4/1951 Tichenor ..... 224/150
2,779,521 A * 1/1957 Granberg ..... 224/150
2,812,123 A * 11/1957 Girton ..... A47D 13/086 242/150
2,884,172 A * 4/1959 Kubo ..... 224/149
2,915,233 A * 12/1959 Moomaw ..... F41C 33/002 224/149
3,282,558 A * 11/1966 Swain ..... F16K 1/2263 251/173
3,441,185 A * 4/1969 Moomaw ..... F41C 33/00 224/150
3,495,770 A * 2/1970 Rolling ..... F41C 33/002 224/150
3,595,451 A * 7/1971 Branby ..... F41C 33/002 224/150
3,948,423 A * 4/1976 Hathaway ..... F41C 33/002 224/150
4,249,686 A * 2/1981 Morwood ..... 224/150
4,511,070 A * 4/1985 Hightower ..... F41C 23/02 224/150
4,542,810 A * 9/1985 Shimbara ..... G11B 15/67542 188/290
4,542,840 A * 9/1985 Pepper, Sr. ..... F41C 33/001 224/150
4,562,942 A * 1/1986 Diamond ..... B65D 83/62 222/386.5
4,562,945 A * 1/1986 Erlandson ..... 224/150
5,082,155 A * 1/1992 Salvador ..... F41C 33/001 224/150

(Continued)

*Primary Examiner* — Justin Larson
*Assistant Examiner* — Lester L Vanterpool
(74) *Attorney, Agent, or Firm* — R. Tracy Crump

(57) ABSTRACT

A weapon sling that provides a "shoulder carry" loop used for shoulder carrying a weapon and a "shooting" loop used to stabilize the user's support arm in a "supported" shooting position. The sling uses a three point connection design and includes three interconnected strap members: a front shoulder strap, rear shoulder strap, and a sliding shooting strap. The free ends of the front and rear shoulder straps are adjustably connected by an adjustable slide, which forms the shoulder loop. The free end of the shooting strap is connected to slide along a portion of the length of the front shoulder strap, which forms the shooting loop.

5 Claims, 12 Drawing Sheets

(56) References Cited

U.S. PATENT DOCUMENTS 5,282,558 A * 2/1994 Martinez ..... 224/150
5,353,538 A * 10/1994 Hakedal ..... F41C 23/02 224/150
5,710,022 A * 1/1998 Zhu ..... C07K 14/14738 435/252.3
5,715,979 A * 2/1998 Crandall ..... F41C 23/02 224/150
5,915,939 A * 6/1999 French ..... F41C 23/02 224/150
6,068,167 A * 5/2000 Hopson ..... A45C 13/30 224/150
6,325,258 B1 * 12/2001 Verdugo et al. ..... F41C 33/001 224/149
6,932,254 B2 * 8/2005 Eliason ..... 224/150
8,430,825 B2 * 4/2013 Mark ..... A61B 10/0275 600/564
2006/0208016 A1 * 9/2006 Esch ..... A45F 3/14 224/150
2007/0278261 A1 * 12/2007 Gallagher ..... F41C 33/001 224/150
2008/0217371 A1 * 9/2008 Wemmer ..... F41C 33/00 224/579
2012/0255976 A1 * 10/2012 Dees ..... F41C 33/002 224/150

* cited by examiner

WEAPON SLING

This invention relates to a weapon sling and in particular a long gun (rifle or shot gun) sling having an adjustable support arm stabilizing loop.

BACKGROUND AND SUMMARY OF THE INVENTION

Weapon slings allow users to carry and suspend weapon, particularly long guns, such as rifles and shotguns on their bodies. Weapon slings are also useful as shooting aids. A weapon sling affixed to a rifle or shotgun can be manipulated to provide support and stability to the weapon in most shooting positions.

In 1986, Eric S. Ching developed a tactical rifle sling, known as the "Ching" sling, which provides fast acquisition to a supported shooting position that stabilize the user's support arm. The Ching sling consists of a main strap, which is attached to the forearm and buttstock sockets like a normal carry sling, and a short fixed strap, which forms a "shooting" loop. With the user's support arm inserted through the "shooting" loop, the short strap lays flat and firm against the back of the user's support arm, thereby providing support arm stabilization during shooting. While the "Ching" sling facilitates a more stabilized shooting position, the conventional Ching sling cannot be readily adjusted while in use. In many tactical applications, it is advantageous to adjust the length of the "shooting" loop, as well as the length of the overall sling.

The present invention provides a weapon sling that provides a "shoulder carry" loop used for shoulder carrying a weapon and a "shooting" loop used for stabilizing the user's support arm in a "supported" shooting position, which can both be readily lengthened or shortened as desired while in use. The sling uses a three point connection design and includes three interconnected strap members: a front shoulder strap, rear shoulder strap, and a sliding shooting strap. One end of each strap is connected directly to the weapon: one near the distal end of the butt stock, at the front of the hand guard and at the rear of the hand guard immediately in front of the weapon receiver. The free ends of the front and rear shoulder straps are adjustably connected by an adjustable slide, which forms the shoulder carry loop. The free end of the shooting strap is connected to slide along a portion of the length of the front shoulder strap, which forms the shooting loop. The length of both the shoulder carry loop and the support loop can be selectively set to suit any particular user. A user can also adjust the length of the shoulder carrying loop while donning the sling by pulling on the free end of the front shoulder strap, which shortens the shoulder carry loop or by pulling on a pull cord affixed to the adjustment slide, which lengthens the shoulder carry loop.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangements of system and method components. The drawings are only for purposes of illustrating exemplary embodiments and are not to be construed as limiting the invention. The drawings illustrate the present invention, in which.

DESCRIPTION OF THE PREFERRED EMBODIMENT

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural and mechanical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
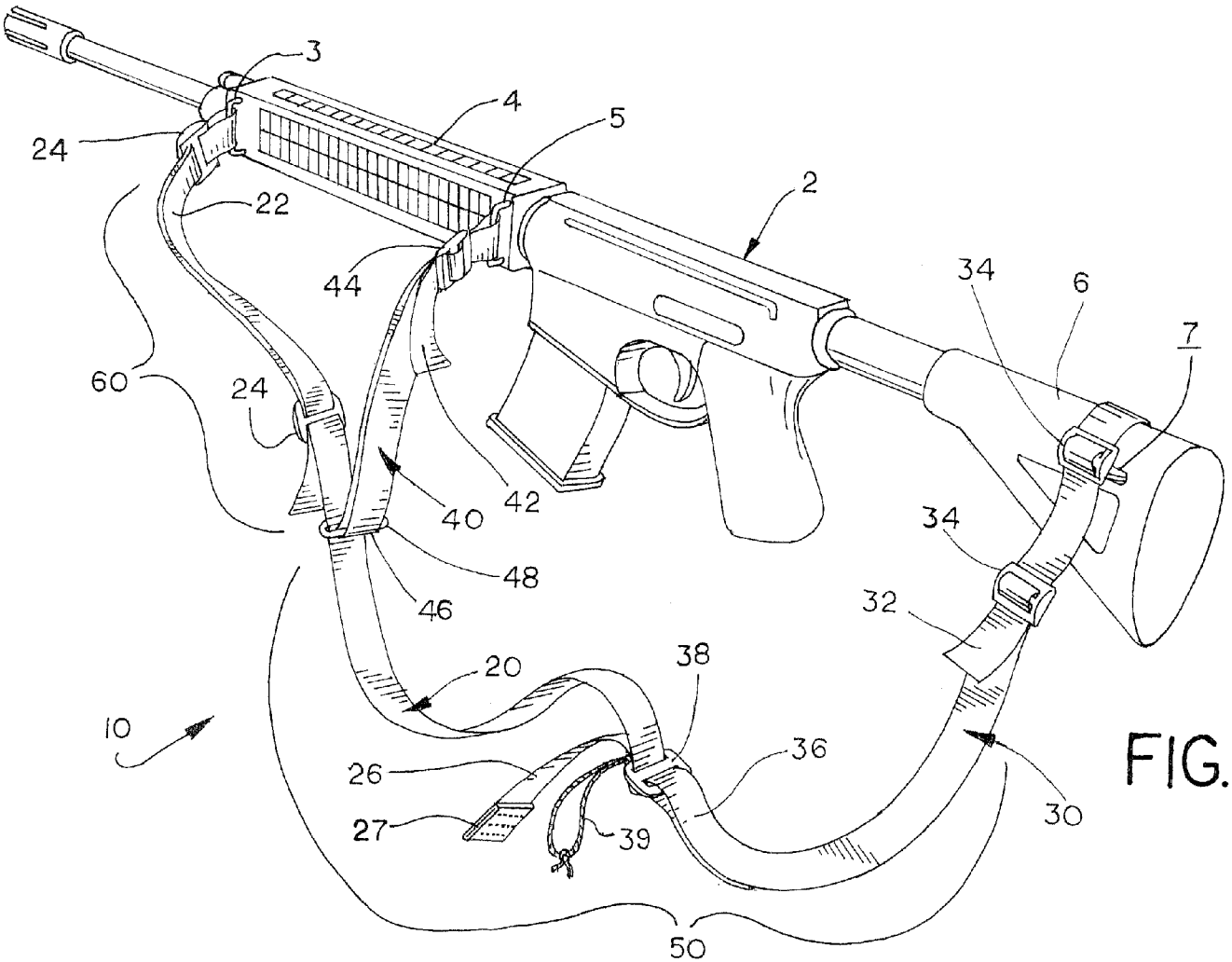
FIG. 1 is a perspective view of an embodiment of the sling of this invention fitted to a conventional AR-15 style rifle.
Figure 2:
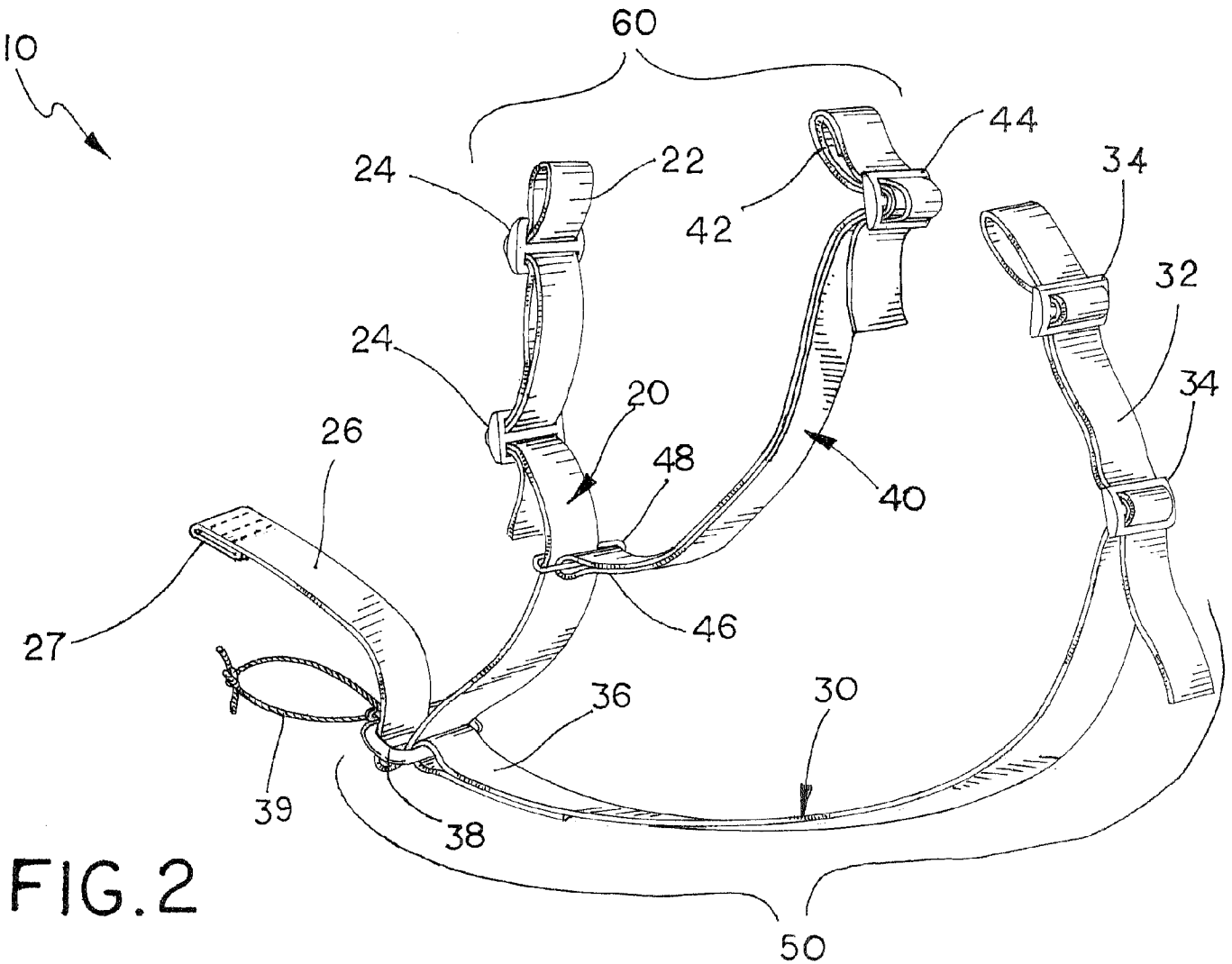
FIG. 2 is a perspective view of the sling of FIG. 1.
Figure 3:
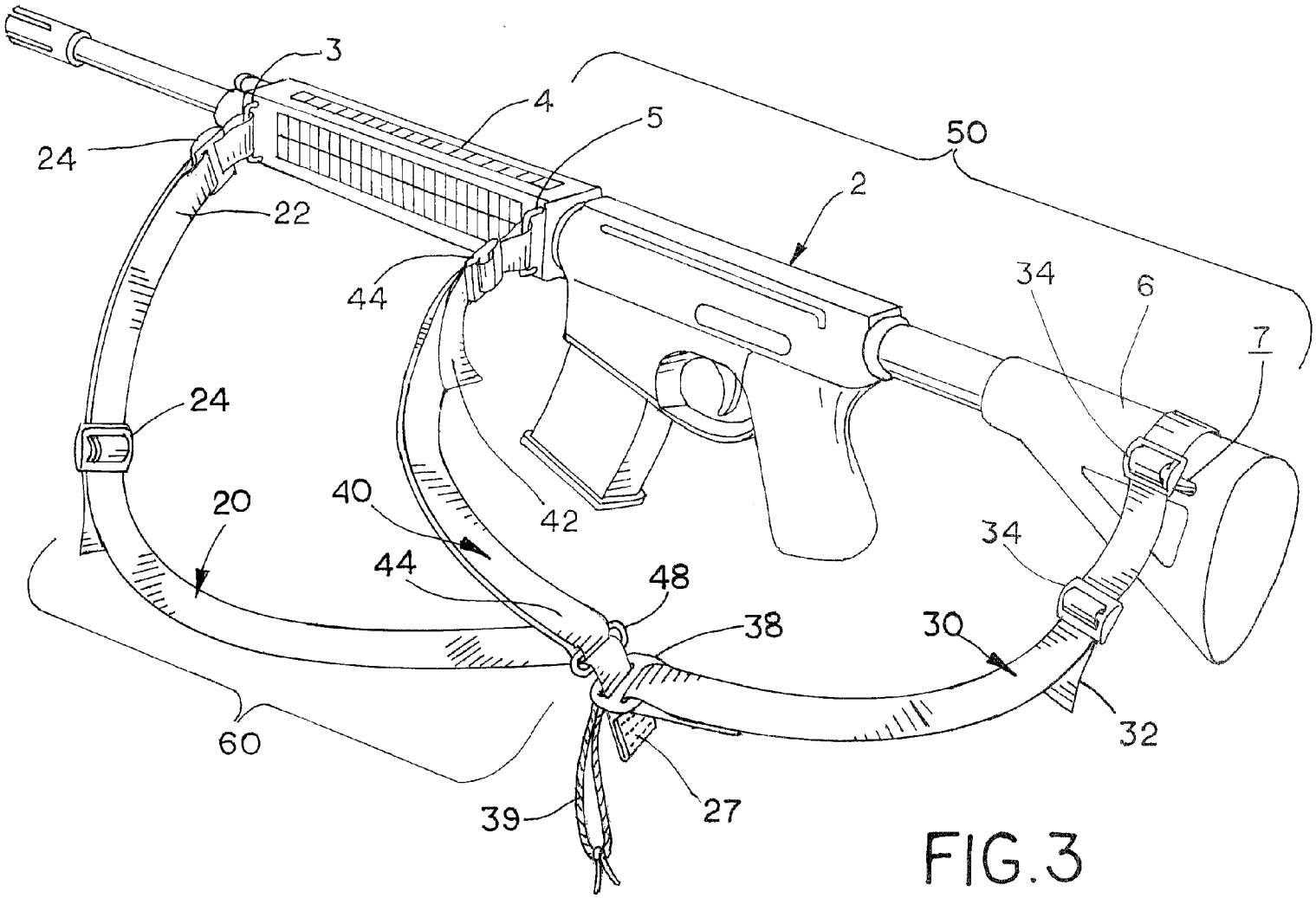
FIG. 3 is another perspective of the sling of FIG. 1 fitted to a conventional AR-15 style rifle.
Figure 4:
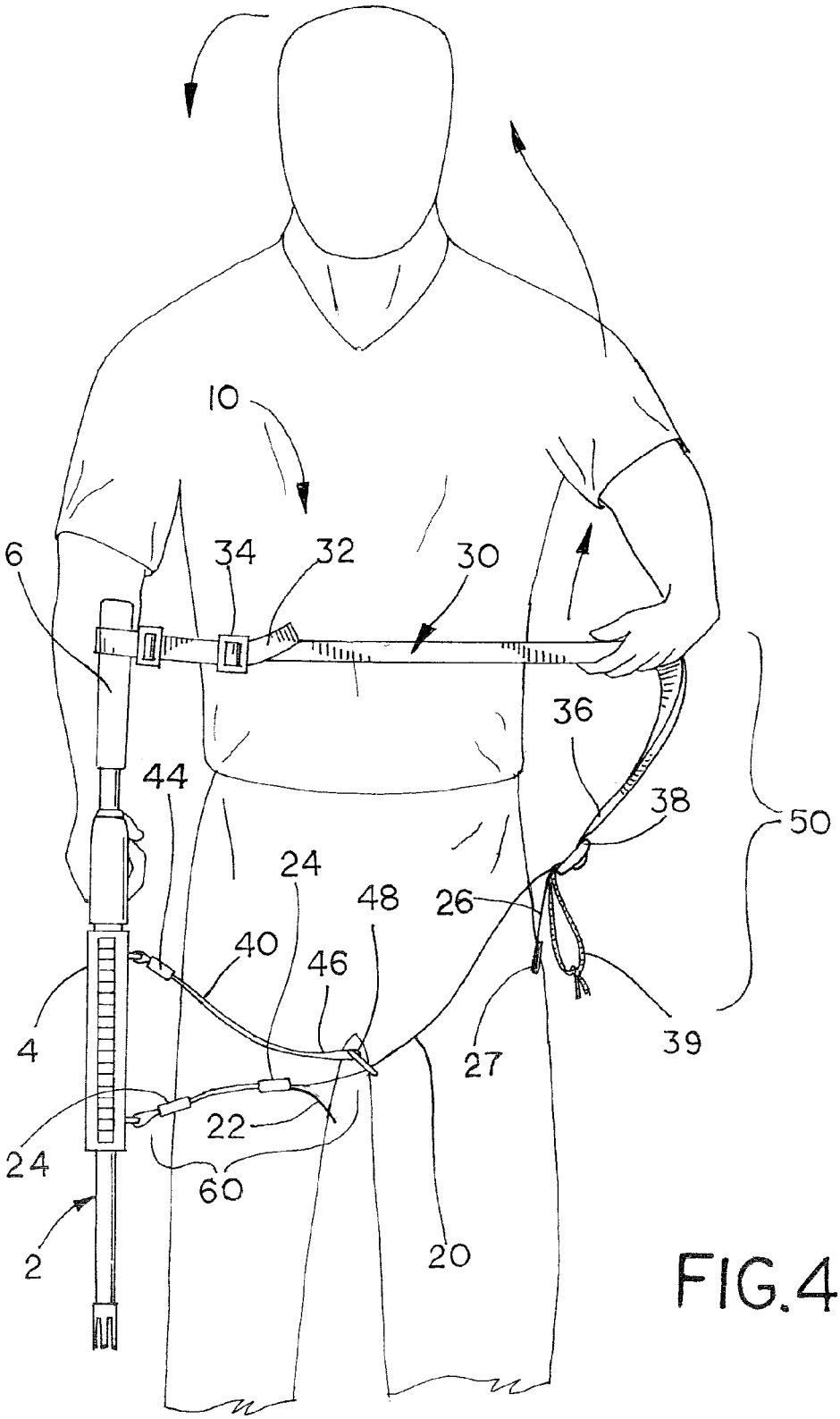
FIG. 4 is a front view of a standing right handed user preparing to don the rifle and sling of FIG. 1.
Figure 5:
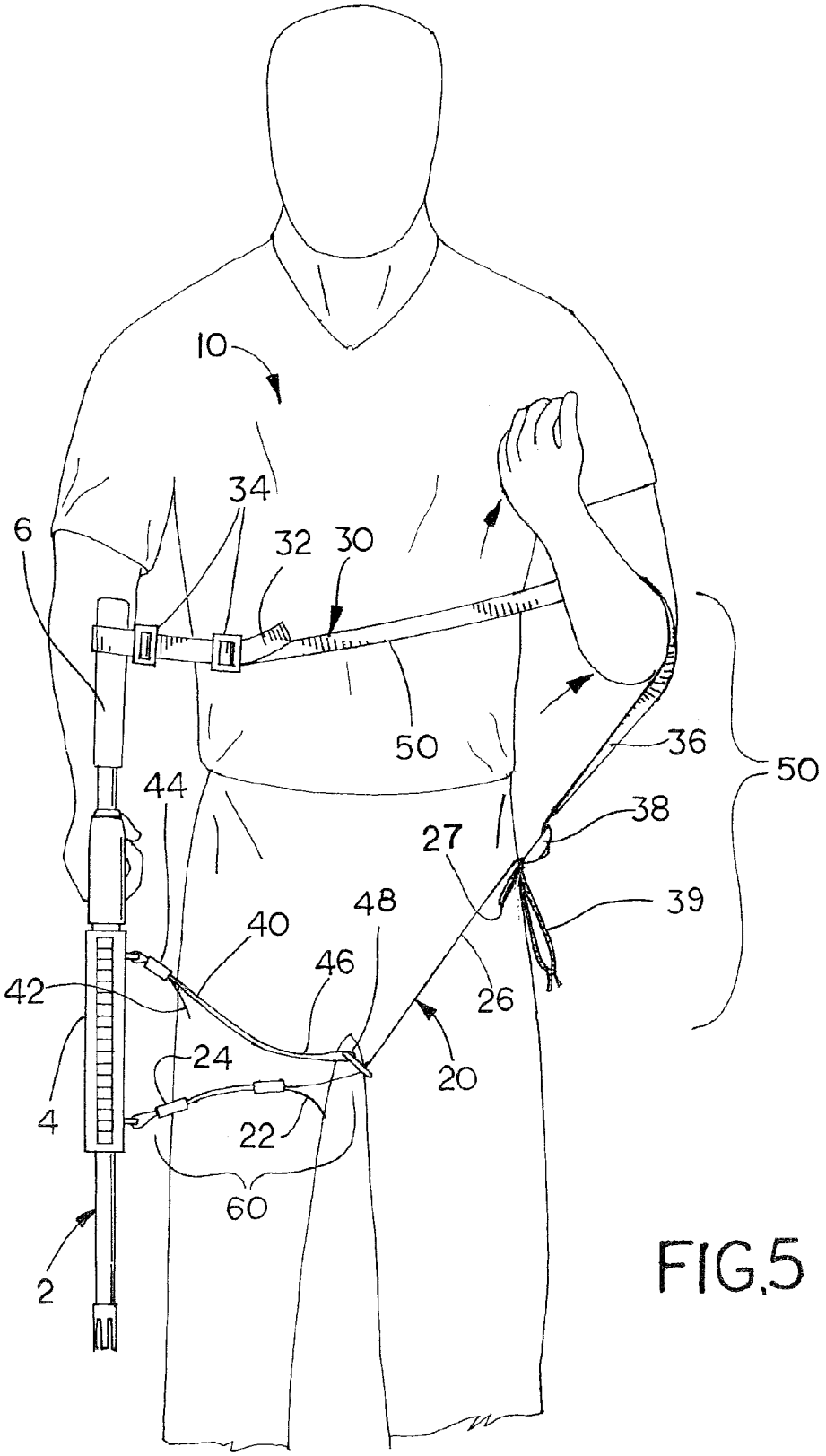
FIG. 5 is a front view of the user of FIG. 3 inserting his left arm under the shoulder loop of the sling.

Referring now to the drawings, FIGS. 1-3 illustrate an embodiment of the present invention where the weapon sling is designated generally as reference numeral 10. Sling 10 may be adapted for use with a variety of firearms, such as rifles and shot guns within the teachings of this invention. For simplicity of explanation, an embodiment of the sling of this invention is illustrated and described herein used with a typical AR-15 style semi-automatic rifle, but may be used with other types of firearms, such as bolt action rifles, pump action and semi-automatic shotguns within the teachings of this invention. The sling may be adapted to attach to the weapon using a variety of methods and/or connectors. For simplicity of explanation, sling 10 is illustrated in the drawings using a minimal connection method without any special connection hardware. It is well known in the art that long guns, such as rifles and shotguns, are often equipped with one or more sling swivels or other connectors at various locations to accommodate a conventional rifle sling. As shown, rifle 2 has a pair of fixed sling rings 3 and 5 mounted to the front and rear of hand guard 4 to which straps 20 and 40 are connected respectively and a slot 7 formed in the butt stock through which strap 40 is connected. In other embodiments of the sling of this invention, each strap 20, 30 and 40 may include additional connection hardware, such as QD sling swivels, Heckler & Koch style snap hooks, buckles, mash hooks and the like that connect the sling to corresponding attachment points and hardware on the weapon. Such connection hardware used in weapon slings is well known and understood within the art.

Figure 10:
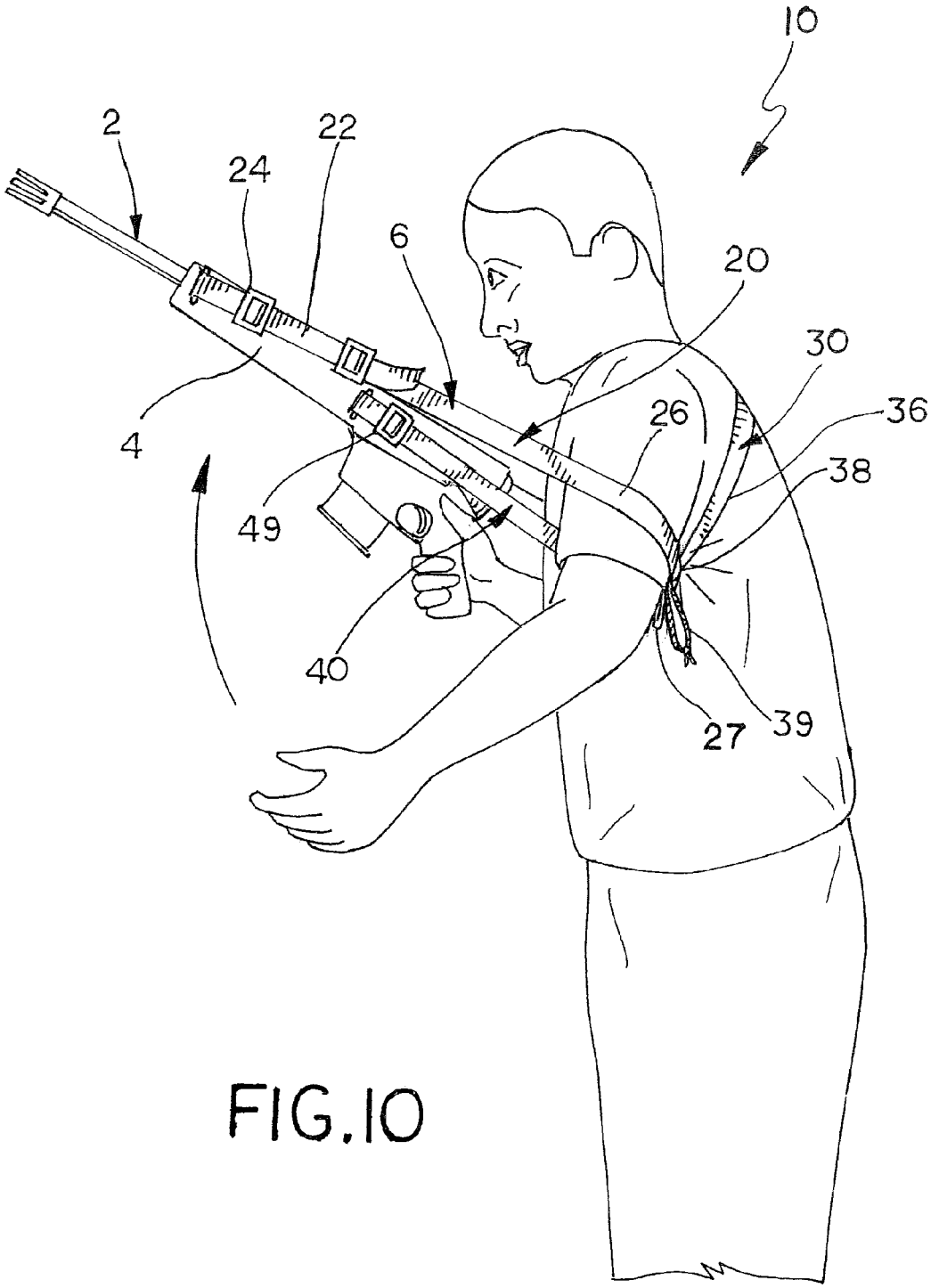
FIG. 10 is a side view of a standing right handed user donning the sling of FIG. 1 shown inserting his left hand through the shooting loop for a support shot.
Figure 11:
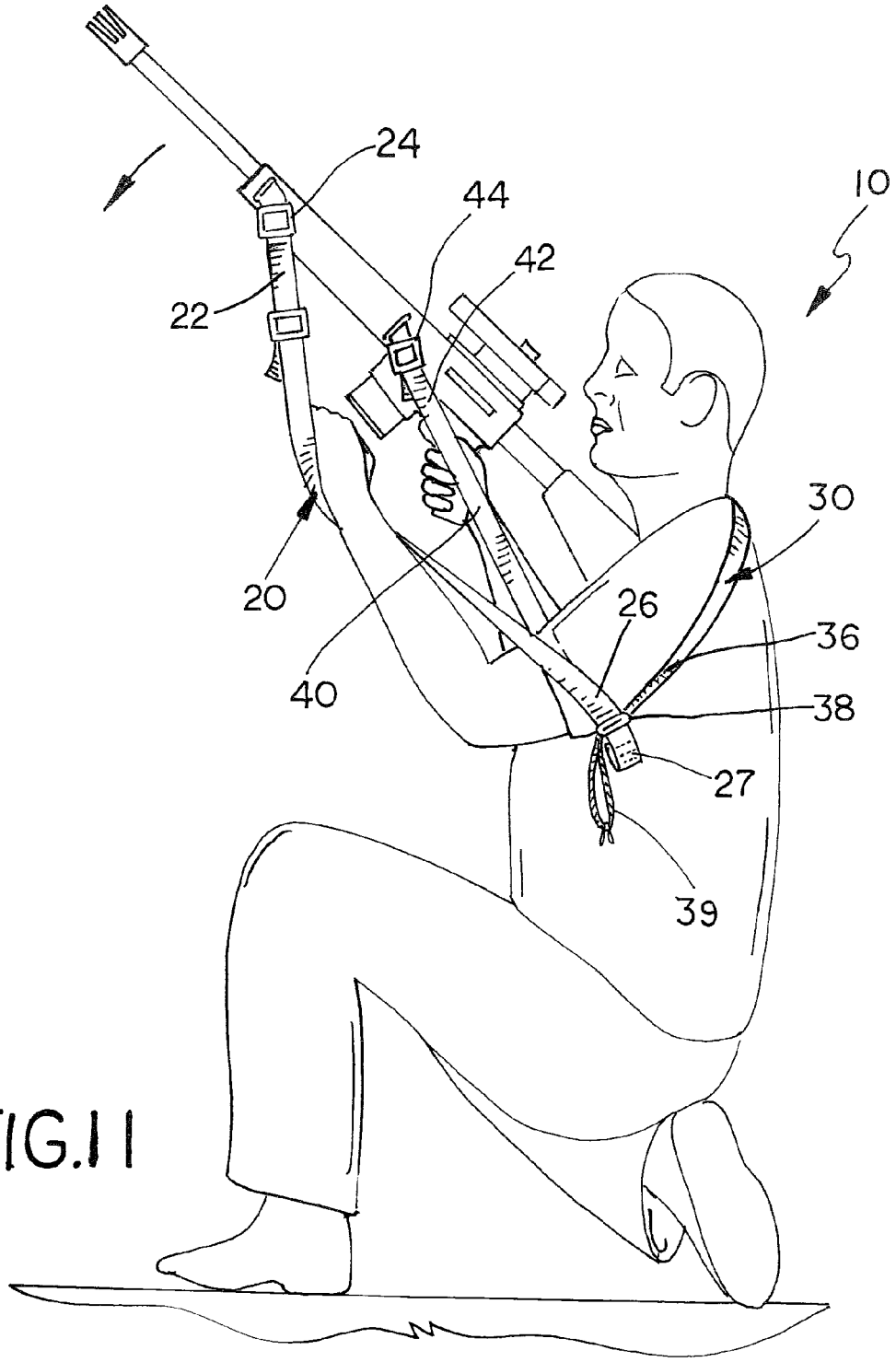
FIG. 11 is a side view of the user of FIG. 10 kneeling to a supported shooting position while donning the sling of FIG. 1.
Figure 12:
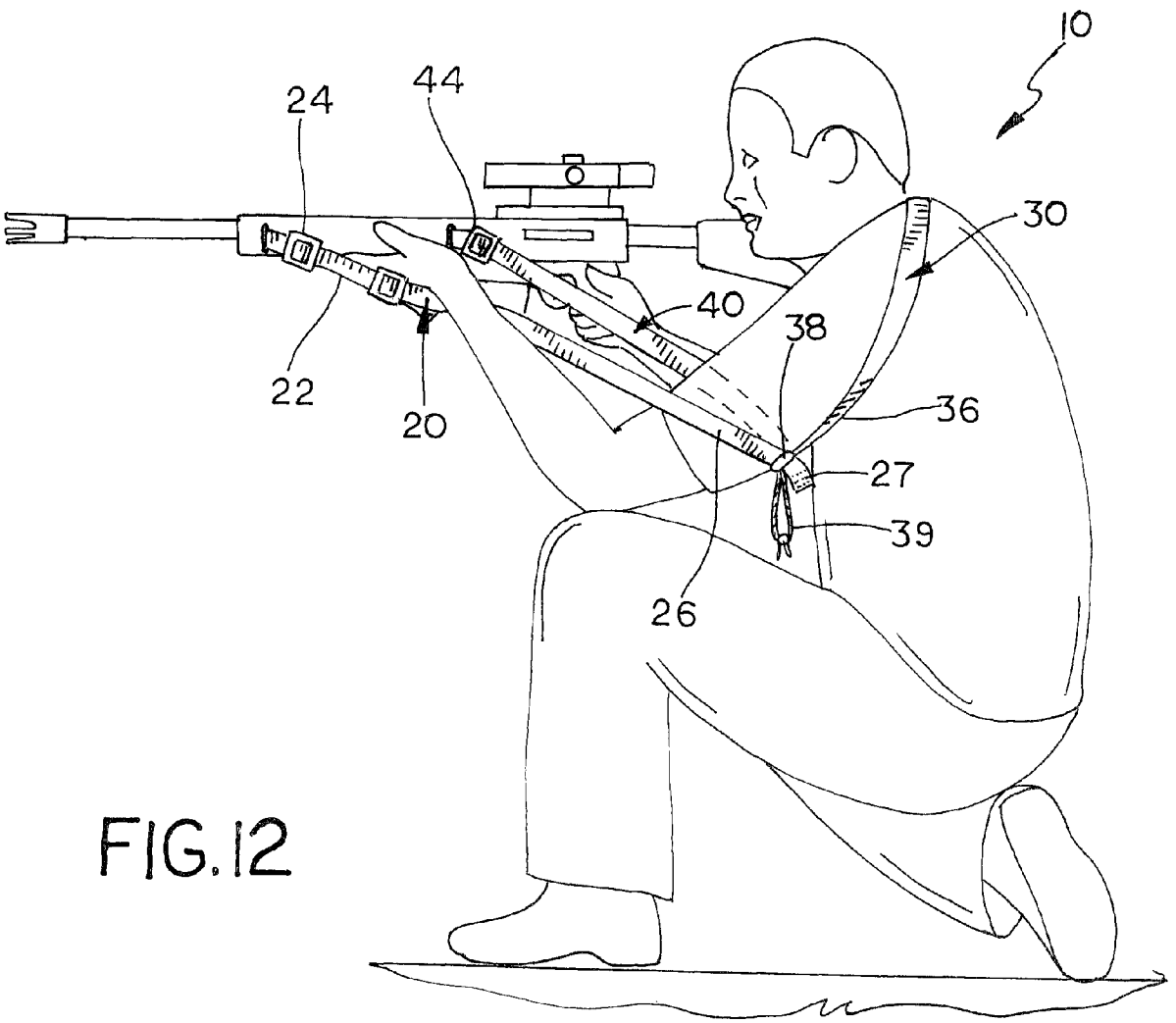
FIG. 12 is a side view of the user of FIG. 10 in a supported kneeling position using the shooting loop of the donned sling of FIG. 1 to support the rifle.

Sling 10 consists of three interconnected strap members: a front should strap 20, rear shoulder strap 30 and sliding "Shooting" strap 40. One end of each strap 20, 30 and 40 is connected directly to rifle 2. As shown, sling 10 employs a "three point" connection design meaning the sling connects to the weapon at three separate locations: near the distal end of the butt stock 4, at the proximal end of the forward hand guard 6 and at the distal end of the hand guard immediately in front of the receiver 8. The free ends of straps 20 and 30 are adjustably connected to form "shoulder carrying" loop 50 for carrying rifle 2 (FIGS. 4-7). The free or "sliding" end 46 of shooting strap 40 is connected to slide along a portion of the length of strap 20 and to form "shooting" loop 60 with strap 20 when affixed to a weapon for receiving the user's elbow in a supported shooting position (FIGS. 10-12).

Figure 6:
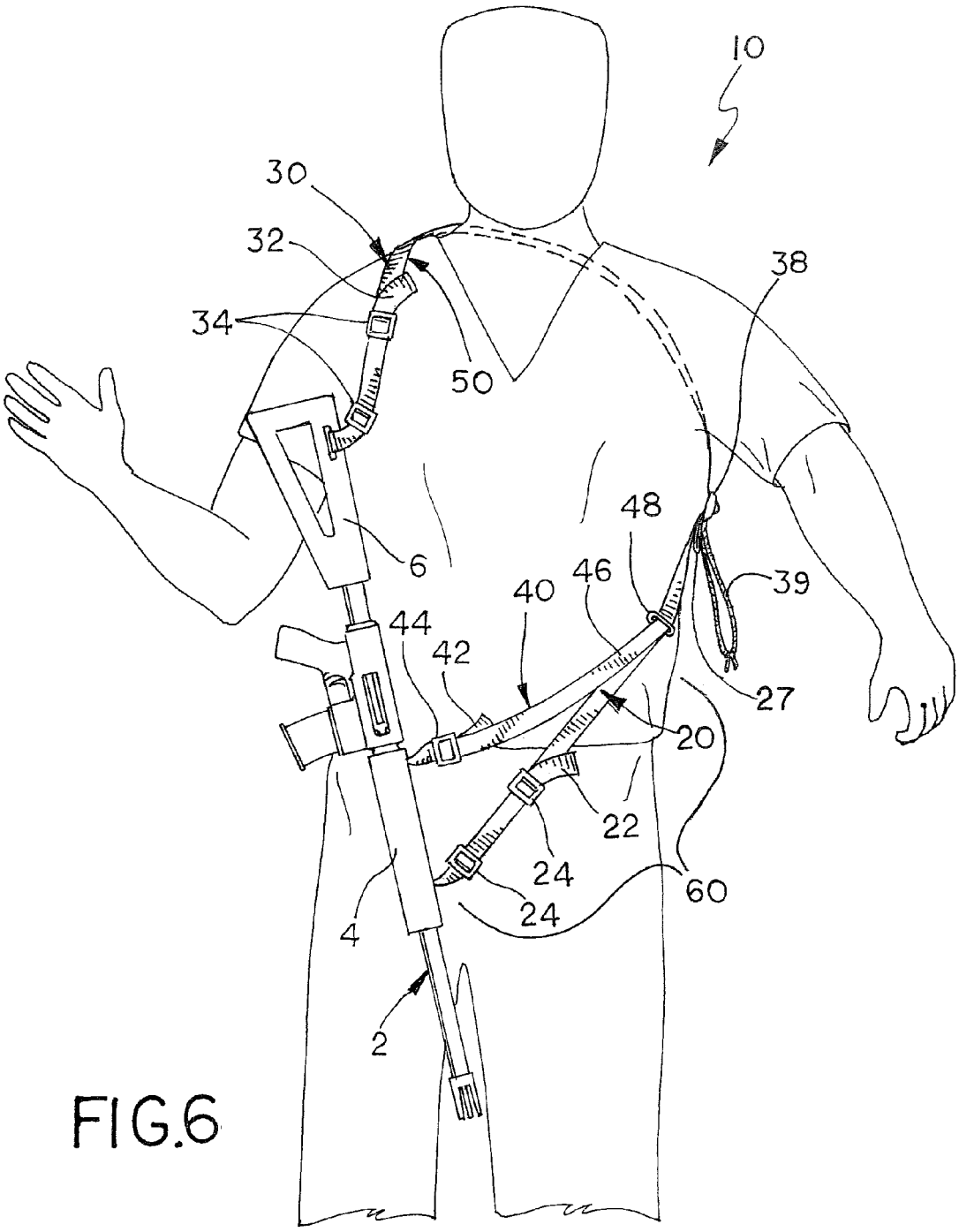
FIG. 6 is a front view of the user of FIG. 3 with the rifle and sling donned.
Figure 7:
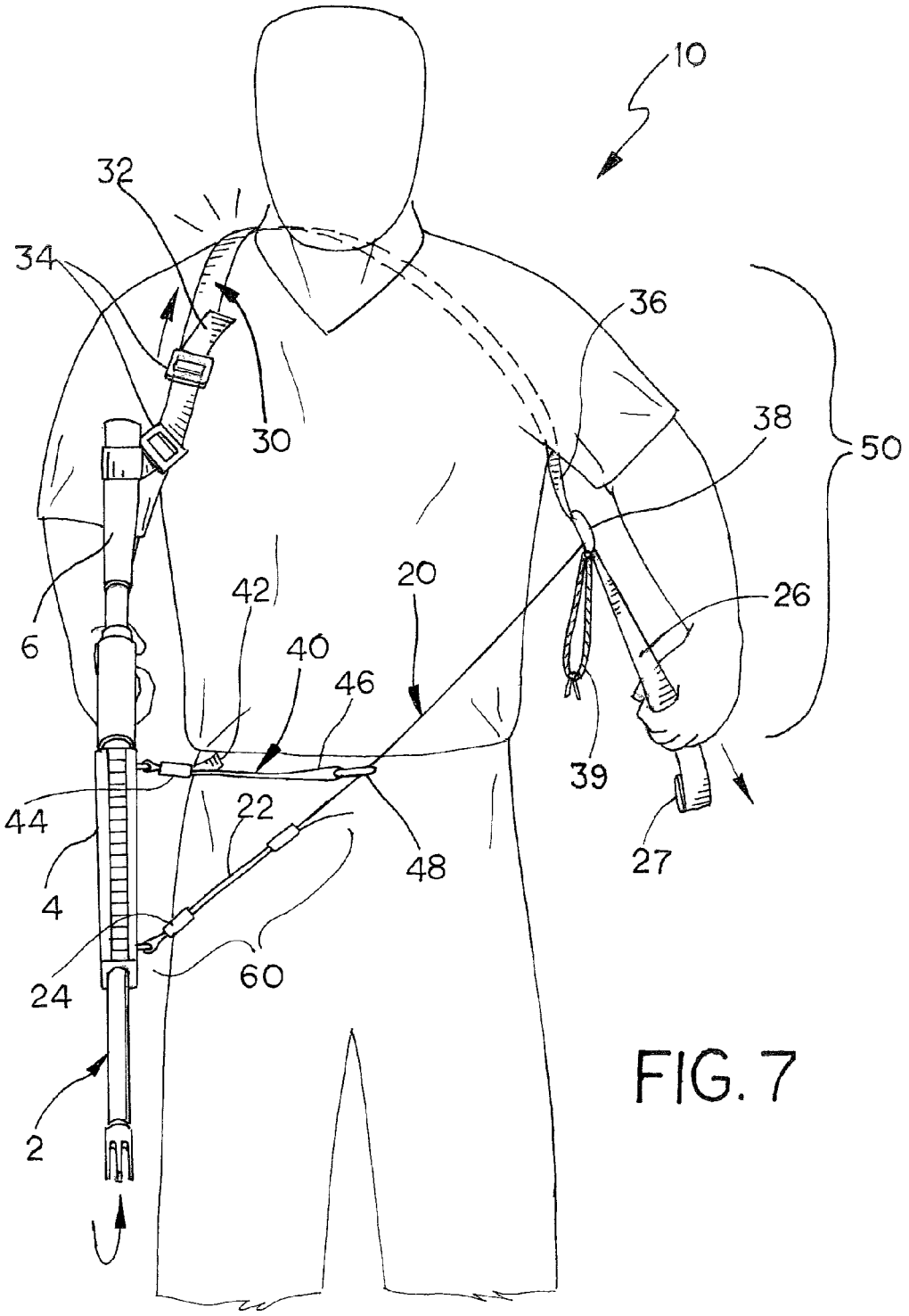
FIG. 7 is a front view of the user of FIG. 3 tightening the shoulder loop of the sling around his body.
Figure 8:
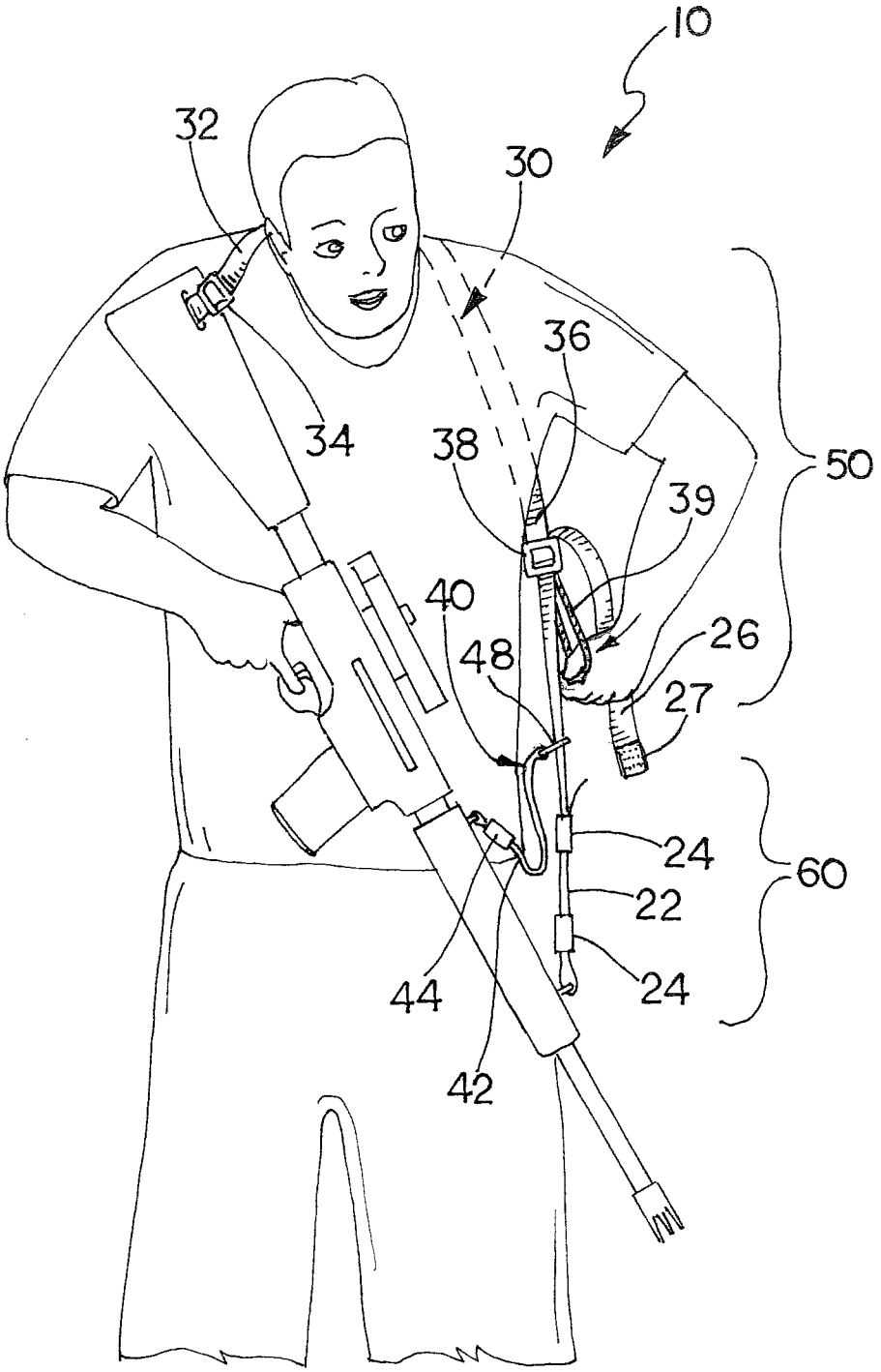
FIG. 8 is a front view of a standing right handed user preparing to loosen the sling donned around his body.

Straps 20, 30 and 40 are constructed typically of flat woven strips or tubes of high-strength polymer materials, such as Nylon, Polyester, and Polypropylene. While polymer webbing is preferable, other traditional sling materials, such as cloth or leather straps may be used. In the present embodiment, each strap 20, 30 and 40 includes one or more adjustment slides 24, 34 and 44 of the type available from ITW Nexus North America of Des Plaines, Ill. to securely connect an end of the strap to rifle 2. Adjustment slides 24, 34 and 4 also allow the lengths of straps 20, 30 and 40 to be secured to rifle 2 and also allow the straps to be shortened and lengthened as desired for any given user. As shown, the fixed end 22 of strap 20 is connected to sling ring 3 at the front of the hand guard 4 and secured by a pair of adjustment slides 24. The fixed end 32 of strap 30 is inserted through slot 7 and wrapped around butt stock 6 and secured again by a pair of adjustment slides 34. The free ends of straps 20 and 30 are connected together to form a shoulder loop when attached to the weapon for carrying rifle 2 over the shoulder (FIG. 6). An adjustable slide connector 38 is permanently fixed to the free end 36 of strap 30. Slide connector 38 connects the free end 26 of strap 20 to free end 36 of strap 30, which allows the overall length of shoulder loop 50 to be adjusted. Free end 26 of strap 20 terminates in stop 27, which is formed by sewing together the overlapped end of the strap. Slide connector 38 is selected to allow easy one handed release and tightening of the webbing or strap, such as the ITW Nexus Ladderloc™. Slide connector 38 has a pull cord 39 extending through the end tab of slide connector 38, which allows the user to grasp the end tab more easily to loosen shoulder carrying loop 50. One end 42 of slide strap 40 is looped through sling ring 5 and secured by adjustment slider 44. The opposite or "sliding" end 46 of strap 40 terminates in a slide ring 48 that freely shiftably slides along the length of strap 20 between slider 25 and slide connector 38. Slide ring 48 is of the type available again from ITW Nexus North America, and is typically constructed of a strong durable polymer material, but may be constructed of any suitable composite material or metal as desired. As shown, connector 38 acts as a stop for slide ring 48, which sets the length of support loop 60. Connector 38 allows the user to quickly and easily adjust the overall length of the shooting loop 60, as well as shoulder carrying loop 50.

For proper use, sling 10 must be initially setup to accommodate the particular user, setting both the desired length of the shooting loop 60 and the desired maximum length of shoulder carry loop 50. In setting up sling 10, the length of the shooting loop 60 is first established. The shooting loop 60 is set by first pulling the free end 26 of strap 20 through slide connector 38 until stop 27 abuts the connector. Once free end 26 is pulled to its end through slide connector 38, adjustment slides 24 and 44 are used to selectively set the lengths of strap 20 and 40 to accommodate the desired overall length of shooting loop 60. Once shooting loop 60 is set, the desired maximum length of the shoulder carry loop 50 is set using adjustment slides 44.

Figure 9:
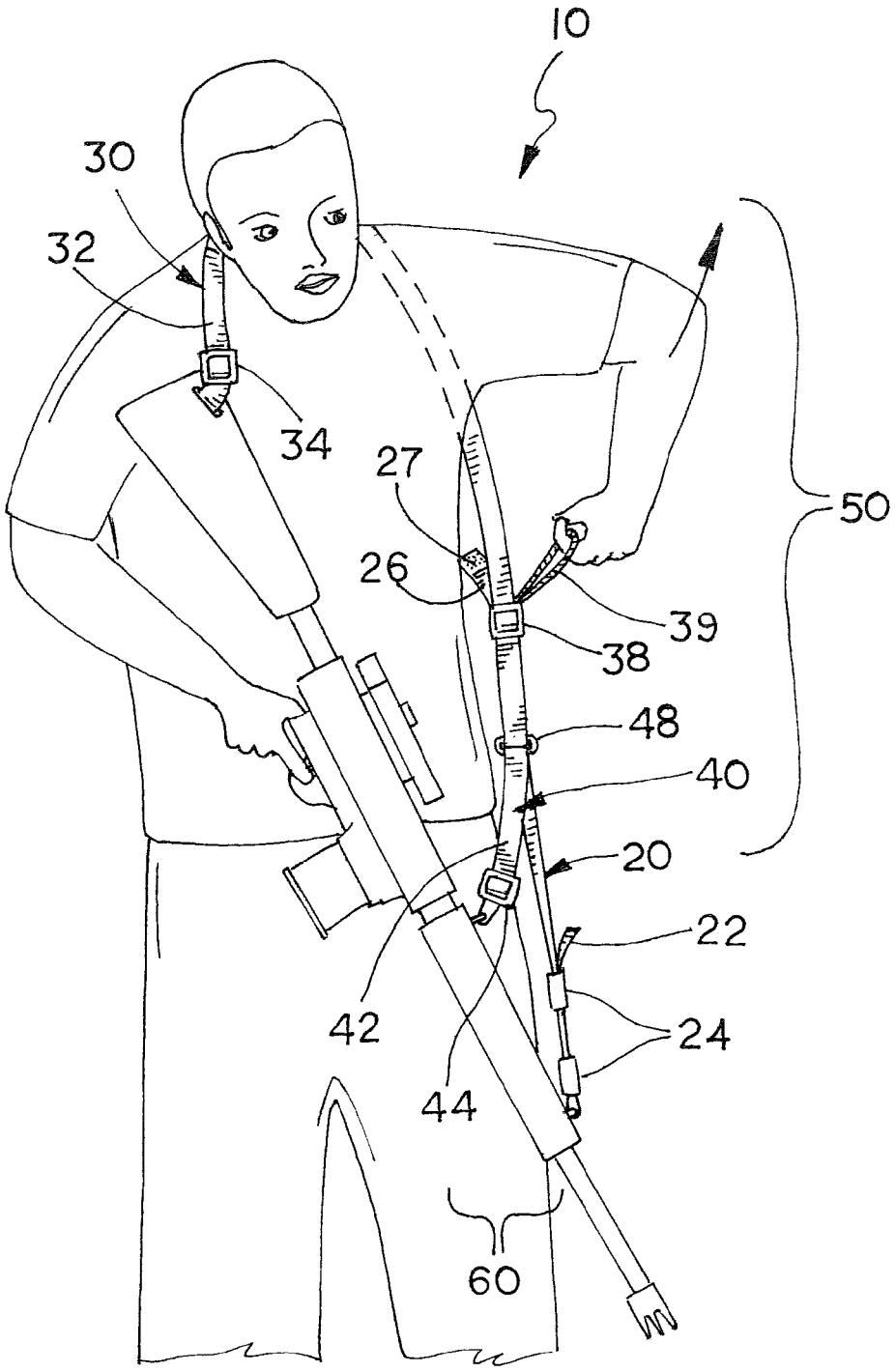
FIG. 9 is a front view of the user of FIG. 9 pulling the slide cord to loosen the shoulder carry loop.

FIGS. 4-12 illustrate the use of sling 10. FIGS. 4-9 illustrate the use of sling 10 to shoulder carry rifle 2. While sling 10 may be used to shoulder carry a long weapon in a variety of traditional manners, for a right handed user, sling 10 is typically worn over the user's right shoulder and under the left arm (FIGS. 4-9). Donning sling 10, the right handed user inserts the left arm underneath and through shoulder loop 50 and pulls the sling over his head. Once donned, the user can tighten or loosen shoulder carry loop 50 by pulling on free end 26 of strap 20 (FIG. 5) or pulling upward on cord 39 (FIG. 9). Tightening and loosening shoulder loop 50 allows the user to adjust how and where rifle 2 is suspended and carry about the user. To doff sling 10, the user simply pulls on pull cord 39 to loosen shoulder loop 50 before pulling sling 10 overhead. It should be noted that while shoulder carrying rifle 2, shooting strap 40 slides freely along strap 20. Furthermore, with rifle 2 suspended in front of the user, the shooting strap 40 falls downward so as to not interfere with normal manipulation of the weapon.

FIGS. 10-12 illustrate the use of shooting loop 60 of sling 10 to provide a supported shooting position. For simiplicity of illustration and explanation, the user is illustrated in a kneeling shooting posture, althrough, sling 10 may be used to provide a supported position in any shooting posture including standing, prone or kneeling. To use shooting loop 60, the user first loosens shoulder carry loop 50 to its maximum length by pulling upward on cord 39. With the shoulder carry loop 50 is at its maximum length, shooting loop 60 is also at the user's desired length with the slide ring 48 abutting against slide connector 38. With the sliding end 46 of strap 40 slid to the end of the strap 20, the user inserts his left (support) arm downward through shooting loop 60, so that the loop rides around the back of the upper arm and high on the upper arm just under the arm pit (FIG. 10). With the support (left) arm inserted through shooting loop 60, the user again assumes a conventional two handed purchase on rifle 2 with the left (support) hand gripping hand guard 4 to draw shooting loop 60 tight around the user's support (left) arm (FIGS. 11 and 12). Tension on shooting loop 60 provided by the user's posture provides the support for rifle 2 regardless of the user's shooting posture. It should be noted that sling 10 does not have to be doffed in order to transition from a shoulder carry posture to a supported shooting posture. Loosening the shoulder carry loop 50 to its maximum length automatically avails shooting loop 60 to the user at the desired length for a supported shooting position, as well as, providing the user sufficient slack in the shoulder carry loop 50 to manipulate rifle 2 into that desired shooting position.

We claim:

1. A weapon sling for a weapon comprising:

a first strap member having a fixed end thereof adapted to connect to the weapon near the proximal end thereof and a free end;

a second strap member having a fixed end thereof adapted to connect to the weapon near the distal end of the weapon and a free end;

an adjustment part fixed to the free end of the second strap member for shiftably joining the free end of the first strap member to the free end of the second strap member thereby forming an adjustable shoulder carrying loop adapted to extend over the user's shoulder and around the user's torso for supporting and suspending the weapon from a user, the free end of the first strap member operatively connected to the adjustment part to allow the length of the shoulder carrying loop to be selectively lengthened or shortened while the sling is supporting or suspending the weapon; and a third strap member having a fixed end thereof adapted to connect to the weapon between the proximal end and the distal end thereof and an opposite end connected to the first strap member for free shiftable movement along the length of the first strap member between the fixed end of the first strap member and the adjustment part, such that the third strap member and the first strap member form a shooting loop adapated to restrictively receive a user's support elbow therein for stabilizing the user's elbow when shooting the weapon.

2. The sling of claim 1 wherein the third strap member includes a slide ring part affixed to the opposite end thereof, the second strap extending through the slide ring part of the third strap member.

3. The sling of claim 1 wherein the slide ring part abuts against the adjustment part when the user's elbow is restrictively received within the shooting loop.

4. The sling of claim 1 wherein the free end of the first strap member operatively connected to the adjustment part to also allow the length of the shooting loop to be selectively lengthened or shortened.

5. The sling of claim 1 wherein the adjustment part is an adjustable slide connector operatively connected to the first strap member.

* * * * *